US011773562B2

(12) United States Patent
Thompson

(10) Patent No.: US 11,773,562 B2
(45) Date of Patent: Oct. 3, 2023

(54) PIN GRABBER COUPLER

(71) Applicant: Caterpillar SARL, Geneva (CH)

(72) Inventor: Mark William Thompson, Manhattan, KS (US)

(73) Assignee: Caterpillar SARL, Geneva (CH)

( * ) Notice: Subject to any disclaimer, the term of this patent is extended or adjusted under 35 U.S.C. 154(b) by 136 days.

(21) Appl. No.: 17/379,278

(22) Filed: Jul. 19, 2021

(65) Prior Publication Data

US 2023/0019996 A1 Jan. 19, 2023

(51) Int. Cl.
*E02F 3/36* (2006.01)

(52) U.S. Cl.
CPC ..... *E02F 3/3622* (2013.01); *E02F 3/3663* (2013.01)

(58) Field of Classification Search
None
See application file for complete search history.

(56) References Cited

U.S. PATENT DOCUMENTS

| | | | | |
|---|---|---|---|---|
| 7,648,305 | B2 | 1/2010 | Beales | |
| 8,112,914 | B2 | 2/2012 | Miller et al. | |
| 8,262,310 | B2 | 9/2012 | Sikorski et al. | |
| 9,194,097 | B2 | 11/2015 | Balemi | |
| 9,217,235 | B2 | 12/2015 | Robl et al. | |
| 9,834,904 | B2 * | 12/2017 | Friedrich | E02F 3/3663 |
| 10,066,359 | B2 * | 9/2018 | De Courcey | E02F 3/3618 |
| 2012/0230760 | A1 * | 9/2012 | Reay | E02F 3/3618 403/316 |

FOREIGN PATENT DOCUMENTS

| | | | | |
|---|---|---|---|---|
| EP | 1852555 | | 11/2007 | |
| GB | 2441322 | A * | 3/2008 | E02F 3/3622 |

OTHER PUBLICATIONS

Written Opinion and International Search Report for Int'l. Patent Appln. No. PCT/EP2022/025330, dated Nov. 15, 2022 (10 pgs).

* cited by examiner

*Primary Examiner* — Michael S Lowe

(57) ABSTRACT

A pin grabber coupler and method for locking and unlocking a tool to a machine is disclosed. The pin grabber coupler may comprise a tertiary lock configured to pivot between an unlocked TL position and a locked TL position. The tertiary lock may include a first and second shoulders, a leg, a tab, a latch, a bias member and a detent. The bias member may be configured to exert a biasing force on the tertiary lock to urge the tertiary lock to the locked TL position. The detent may be configured to exert, when in a hold position, a holding force against the latch that is greater than the biasing force exerted by the bias member. When the detent is in a release position, the holding force applied by the detent against the latch is less than the biasing force applied by the bias member.

14 Claims, 19 Drawing Sheets

PIN GRABBER COUPLER

TECHNICAL FIELD

The present disclosure generally relates to pin grabber couplers, and more particularly, to pin grabber couplers on machines.

BACKGROUND

Use of a pin grabber coupler on a machine allows an operator of the machine to quickly and easily change work tools on the machine (e.g., the bucket) without having to leave the operator compartment. Unlike other coupling systems, a pin grabber facilitates the sharing of tools, and/or buckets and/or attachments (collectively, a "tool" or "tools") among a group of machines.

When connecting a tool to the coupler, the tool and the coupler must be positioned properly in order for the connection to be made. The coupler must be positioned in a way that the tool can be hooked and then fully curled all the way up to the locking position. The tool is then locked onto the coupler once the operator engages the locking sequence. Tools that sit on the ground with their tool pins positioned relatively level or that have a center of gravity that is shifted toward the one of the tool pins may be challenging to pick up. In addition, the position of the tool or machine or both may increase the challenge of coupling the tool to the machine.

U.S. Pat. No. 8,112,914 issued Feb. 14, 2012, discloses a coupler comprising two jaws and a latch for each jaw, one of the latches being powered for movement between a latching position and a non-latching position, and being associated with a blocking mechanism that is remotely moveable between a blocking position and a non-blocking position, and the other latch being independent of the blocking mechanism, but being also remotely moveable between a blocking position and a non-blocking position. The powered latch, in its non-latching position, can maintain both the blocking mechanism in its non-blocking position and the other latch in its non-latching position, irrespective of the orientation of the coupler. While beneficial, a better coupler is desired.

SUMMARY OF THE DISCLOSURE

In one aspect of the present disclosure, a pin grabber coupler for coupling a tool to a machine is disclosed. The tool includes a first tool pin. The pin grabber coupler may comprise a frame, a secondary lock assembly disposed on the frame, and a tertiary lock. The frame includes a hook that defines a concavity having an entrance. The hook is configured to receive the first tool pin in the concavity via the entrance. The secondary lock may include a lock that is pivotable about a pivot axis P between an unlocked SL position and a locked SL position. When in the locked SL position, the lock may be configured to block the first tool pin from being released from or received by the concavity, and when in the unlocked SL position the lock may not block the first tool pin from being received by the concavity of the hook or released from the hook. The tertiary lock may extend along and may be configured to pivot about the pivot axis P between an unlocked TL position and a locked TL position. The tertiary lock may include a first shoulder, a second shoulder, a leg, a tab, a latch, a bias member and a detent. The first shoulder may be disposed on the pivot axis P adjacent to the secondary lock assembly. The second shoulder may be disposed on the pivot axis P and may be spaced apart from the first shoulder. The leg may be disposed between the first shoulder and the second shoulder. The tab may project outward from the leg. The latch may include a body and a catch. The body may extend along the pivot axis P and the catch may project outward from the body. The bias member may be disposed on the pivot axis P and may be configured to exert a biasing force on the tertiary lock to urge the tertiary lock to the locked TL position. The detent may extend along a rocker axis R and the detent may be moveable between a hold position and a release position. The detent is configured to exert, when in the hold position, a holding force against the latch that is greater than the biasing force exerted by the bias member. When the detent is in the release position, the holding force applied by the detent against the latch is less than the biasing force applied by the bias member.

In another aspect of the disclosure, a method is disclosed for locking a tool to a pin grabber coupler on a machine. The tool includes a first tool pin. The pin grabber coupler may include a frame, a secondary lock assembly, and a tertiary lock. The frame may include a hook that defines a concavity having an entrance. The hook is configured to receive the first tool pin in the concavity via the entrance. The secondary lock assembly includes a lock. The method may comprise locking the tool to the pin grabber coupler with the tertiary lock, wherein activation of the tertiary lock is triggered by the first tool pin entering the concavity and exerting a pin activation force on the tertiary lock. The method may further comprise, when the tool is locked to the pin grabber coupler by the tertiary lock, activating the secondary lock assembly to move the lock from an unlocked SL position to a locked SL position, wherein when in the locked SL position, the lock is configured to block the first tool pin from being released from or received by the concavity, and when in the unlocked SL position the lock does not block the first tool pin from being received by the concavity of the hook or released from the hook.

In yet another aspect of the disclosure, a method is disclosed for unlocking a tool from a pin grabber coupler on a machine. The tool includes a first tool pin. The pin grabber coupler may include a frame, a rocker frame, a secondary lock assembly and a tertiary lock. The frame includes a hook defines a concavity having an entrance. The hook is configured to receive and to release the first tool pin in the concavity via the entrance. The secondary lock assembly includes a lock. The tertiary lock may include a detent. The method may comprise pivoting the detent from a hold position to a release position and unlocking the lock by pivoting the lock out of the concavity, wherein when the detent is in the release position, the tertiary lock is unlocked.

DETAILED DESCRIPTION

Reference will now be made in detail to specific embodiments or features, examples of which are illustrated in the accompanying drawings. Generally, corresponding reference numbers will be used throughout the drawings to refer to the same or corresponding parts, unless otherwise specified.

Figure 1:
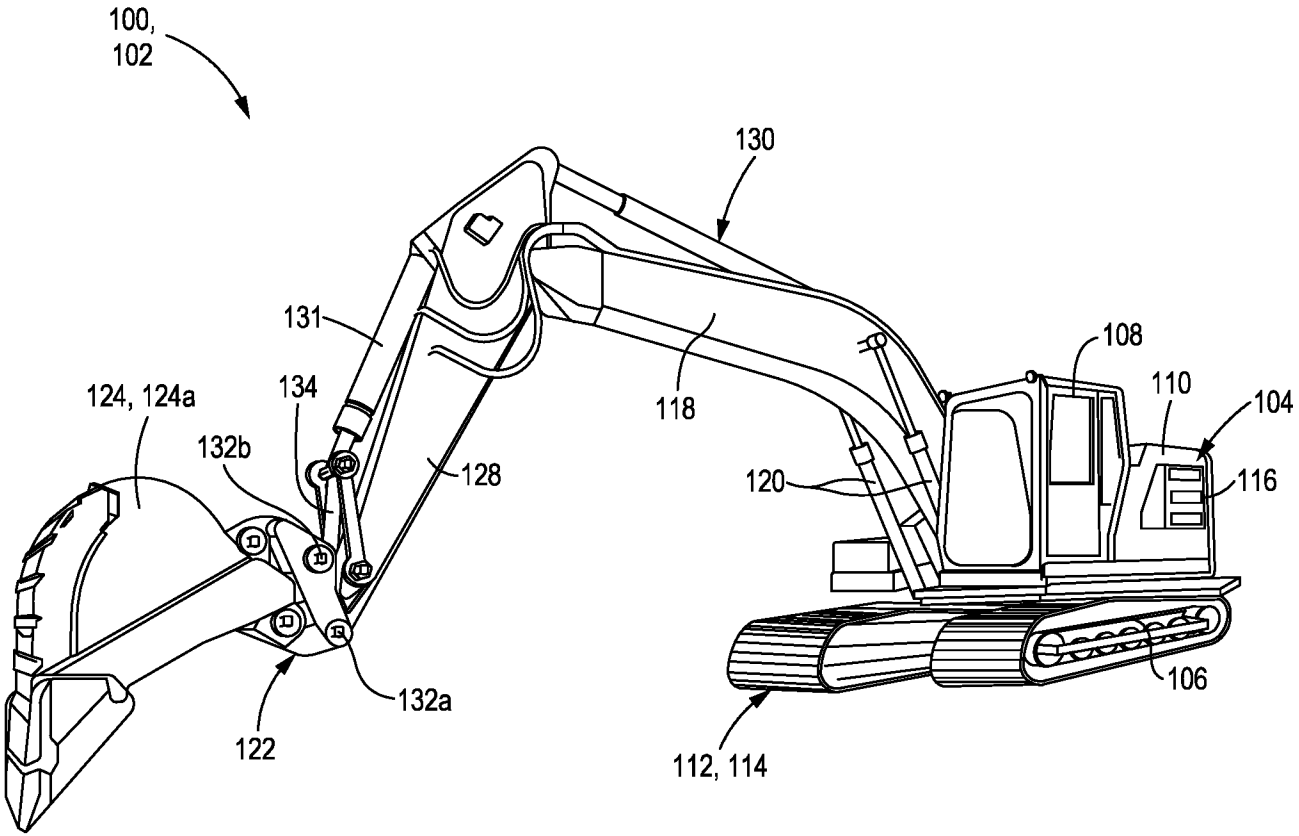
FIG. 1 is a perspective view of an exemplary machine that includes a pin grabber coupler utilizing the teachings of this disclosure.

FIG. 1 illustrates one example of a machine 100 that incorporates the features of the present disclosure. The exemplary machine 100 may be a vehicle such as an excavator 102. While the following detailed description and drawings are made with reference to an excavator 102 as the exemplary machine 100, the teachings of this disclosure may be employed on other machines 100, including, but not limited to, backhoe loaders, hydraulic mining shovels or the like.

The excavator 102 may include an upper carriage 104 rotationally connected to a lower carriage 106. The upper carriage 104 rotates in both the clockwise and the counterclockwise directions. The upper carriage 104 includes an operator station 108 and a body 110. The lower carriage 106 includes one or more ground engaging units 112. In the exemplary embodiment shown in FIG. 1, the ground engaging units 112 are track assemblies 114. One of ordinary skill in the art will appreciate that the machine 100 further includes a power source 116, for example an engine, that provides power to the ground engaging units 112 and a final drive assembly (not shown) via a mechanical or electrical drive train.

The excavator further includes a boom 118 pivotably mounted on the body 110 and a hydraulic actuator assembly including boom actuators 120 which are operable by the user to manipulate the boom 118 by raising and lowering the boom 118 relative to the body 110. The excavator 102 further includes a stick 128 pivotally connected to the boom 118, and a stick actuator 130 operably connected to the stick 128. The stick actuator 130 is configured to pivot the stick 128 about the boom 118.

A pin grabber coupler 122 is disposed at an end of the stick 128 and is configured to receive a tool 124 such as a bucket 124*a*, grapple, a hammer, a compactor or another attachment. In the embodiment shown in FIG. 1, the stick 128 is connected to the pin grabber coupler 122 by a first stick pin 132*a*. The excavator 102 further includes a tool actuator 131 that is operably connected to the pin grabber coupler 122 by a power link 134 coupled to a second stick pin 132*b*. The tool actuator 131 is configured to pivot the pin grabber coupler 122 about the first stick pin 132*a*.

The operator station 108 is configured to house control levers, joysticks, push buttons, and other types of control elements typically known in the art for actuating an operation of the excavator 102, the ground engaging units 112, the boom 118, stick 128 and the pin grabber coupler 122 and the tool 124.

Figure 2:
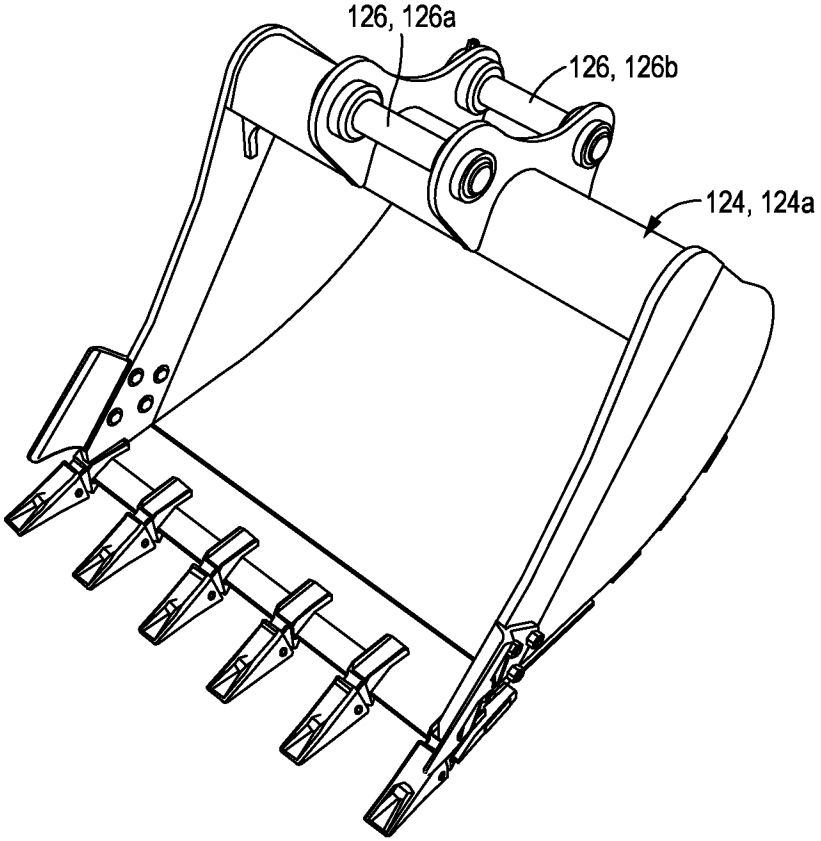
FIG. 2 is a perspective view of an embodiment of the tool of the exemplary machine of FIG. 1.

FIG. 2 illustrates the exemplary tool 124 of FIG. 1, namely a bucket 124*a*. The tool 124 includes one or more tool pins 126. In the exemplary embodiment of FIG. 2, the tool 124 includes a first tool pin 126*a*. In the exemplary embodiment of FIG. 2, the exemplary tool 124 also includes a second tool pin 126*b* that is spaced apart from and generally axially parallel to the first tool pin 126*a*.

FIGS. 3-16 illustrate one exemplary embodiment of the pin grabber coupler 122. The pin grabber coupler 122 includes a frame 136 (best seen in FIG. 3), a primary lock 138 (see FIG. 5), at least one actuator 140, a secondary lock assembly 142, a rocker frame 146 and a tertiary lock 148.

Figure 3:
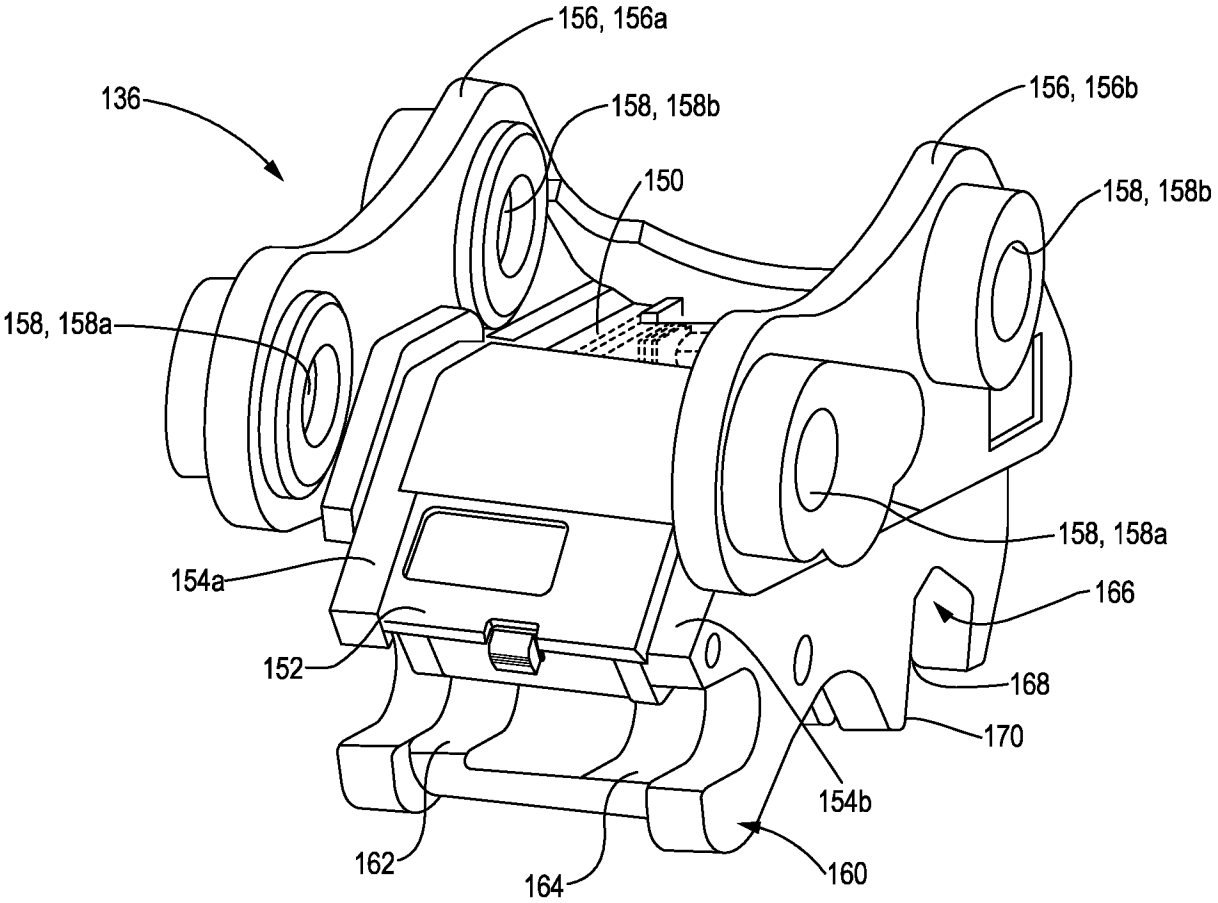
FIG. 3 illustrates a perspective view of an exemplary embodiment of the pin grabber coupler of FIG. 1.
Figure 4:
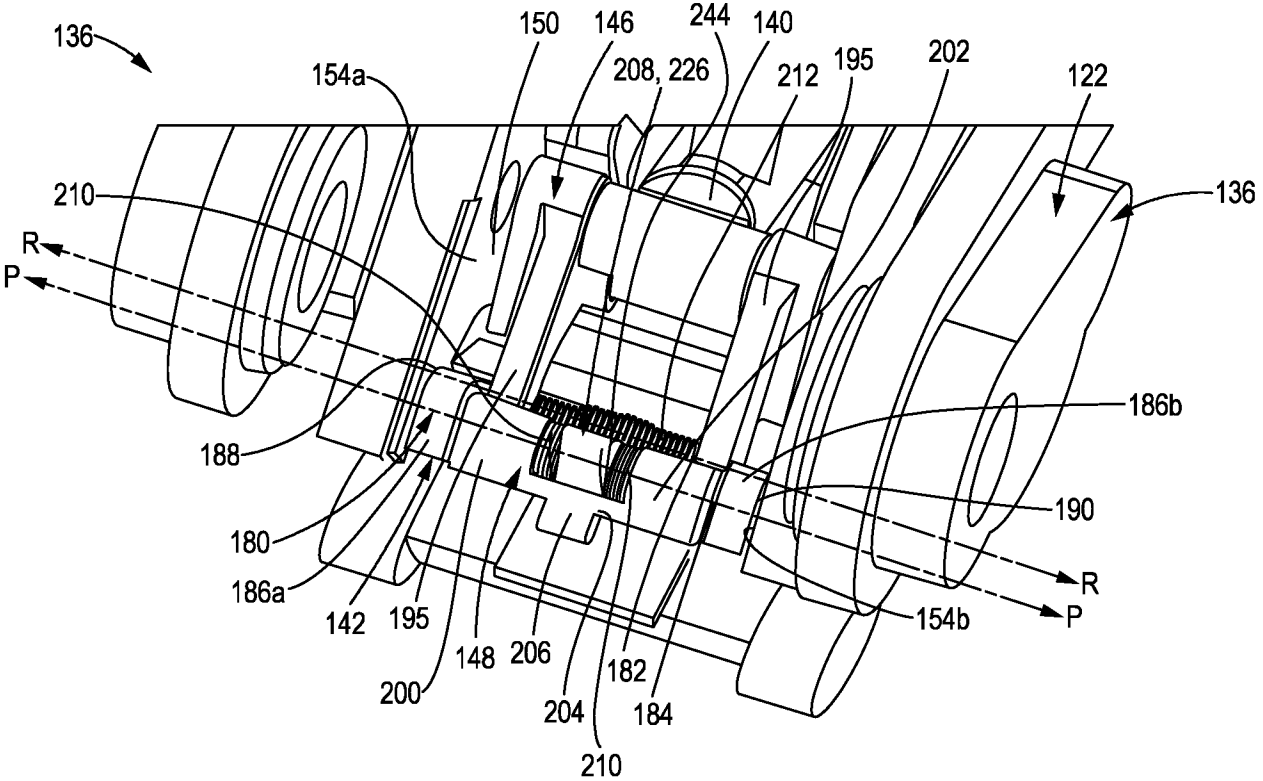
FIG. 4 illustrates a front portion of the frame of FIG. 3 with a cover removed.

As best seen in FIGS. 3-4, the frame 136 defines a cavity 150. The frame 136 includes a cover 152 (removed in FIG. 4 for clarity), a first sidewall 154*a* (FIG. 4) of the cavity 150, a second sidewall 154*b* of the cavity 150, a plurality of side plates 156 (best seen in FIG. 3) and a plurality of ports 158. The first sidewall 154*a* (FIG. 4) is disposed on one side of the cavity 150 and the second sidewall 154*b* is disposed on the opposite side of the cavity 150. A first side plate 156*a* (FIG. 3) may be disposed on the first sidewall 154*a*, and a second side plate 156*b* may be disposed on the second sidewall 154*b*. A first pair of the ports 158*a* (FIG. 3) may be disposed on opposite side plates 156 of the frame 136 and are configured to receive the first stick pin 132*a*. A second pair of the ports 158*b* may be disposed on opposite side plates 156 of the frame 136 and are configured to receive the second stick pin 132*b*.

The pin grabber coupler 122 further includes a hook 160 that defines a concavity 162 having an entrance 164. The hook 160 is configured to receive the first tool pin 126*a* in the concavity 162 via the entrance 164. The pin grabber coupler 122 further includes a notch 166 that defines a chamber 168 having a mouth 170. The notch 166 is configured to receive the second tool pin 126*b* in the chamber 168 via the mouth 170.

The primary lock 138 (FIG. 5) includes a blocking member 172 and is disposed on the frame 136. The blocking member 172 has an engagement end 174 disposed adjacent to the notch 166. The blocking member 172 is moveable from an unlocked PL position 176 to a locked PL position 178 (see FIG. 10) and vice versa. The blocking member 172 is configured to, when moved to the locked PL position 178, at least partially block the mouth 170 of the notch 166 (such that the blocking member 172 blocks the second tool pin 126*b* from being released from the chamber 168), and, when moved to the unlocked PL position 176, the second tool pin 126*b* is not blocked from being received or released from the chamber 168 of the notch 166 by the blocking member 172. The actuator 140 (FIG. 5) may be operably connected to the blocking member 172 and is configured to move the blocking member 172 from the unlocked PL position 176 to the locked PL position 178 (see FIG. 10) and vice versa. When moved to a locked PL position 178, the blocking member 172 is translated in a first direction to move the engagement end 174 (of the blocking member 172) into the notch 166 to at least partially block the mouth 170 of the notch 166 (such that the blocking member 172 blocks the second tool pin 126*b* from being released from the chamber 168). When moved to an unlocked PL position 176, the blocking member 172 is translated in a second direction (opposite to the first) to move the engagement end 174 out of the notch 166 so that the second tool pin 126*b* is not blocked from being received or released from the chamber 168 of the notch 166. The blocking member 172 may be, for example, a wedge or other appropriate structure.

The actuator 140 may include a hydraulic cylinder, an electric actuator or other appropriate actuator. The actuator 140 is configured to activate movement of the blocking member 172 from an unlocked PL position 176 to a locked PL position 178 (see FIG. 10) and vice versa.

Figure 10:
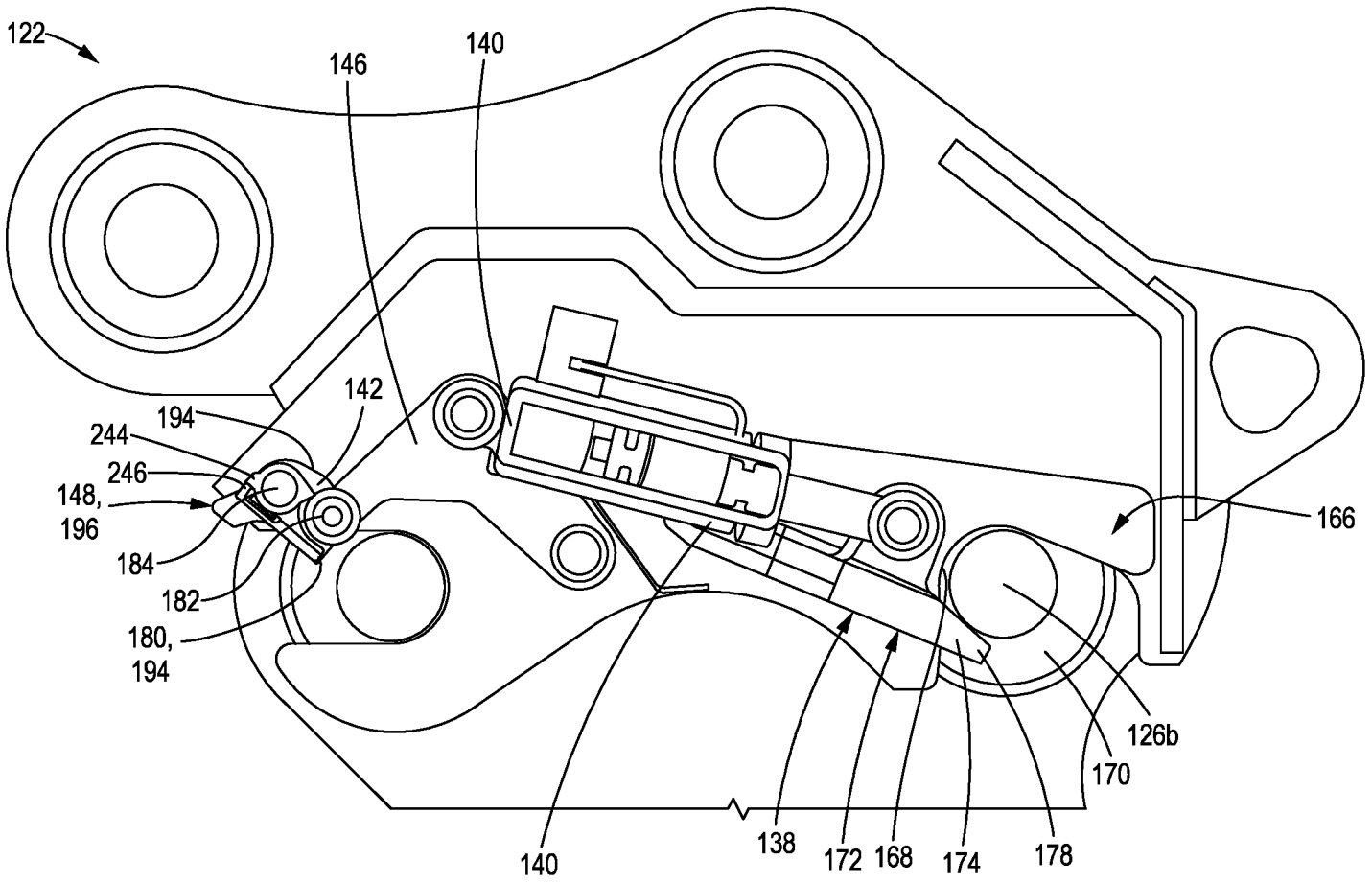
FIG. 10 illustrates the tertiary lock in the locked TL position, the lock of the secondary lock assembly in the locked SL position and the primary lock in a locked PL position.
Figure 11:
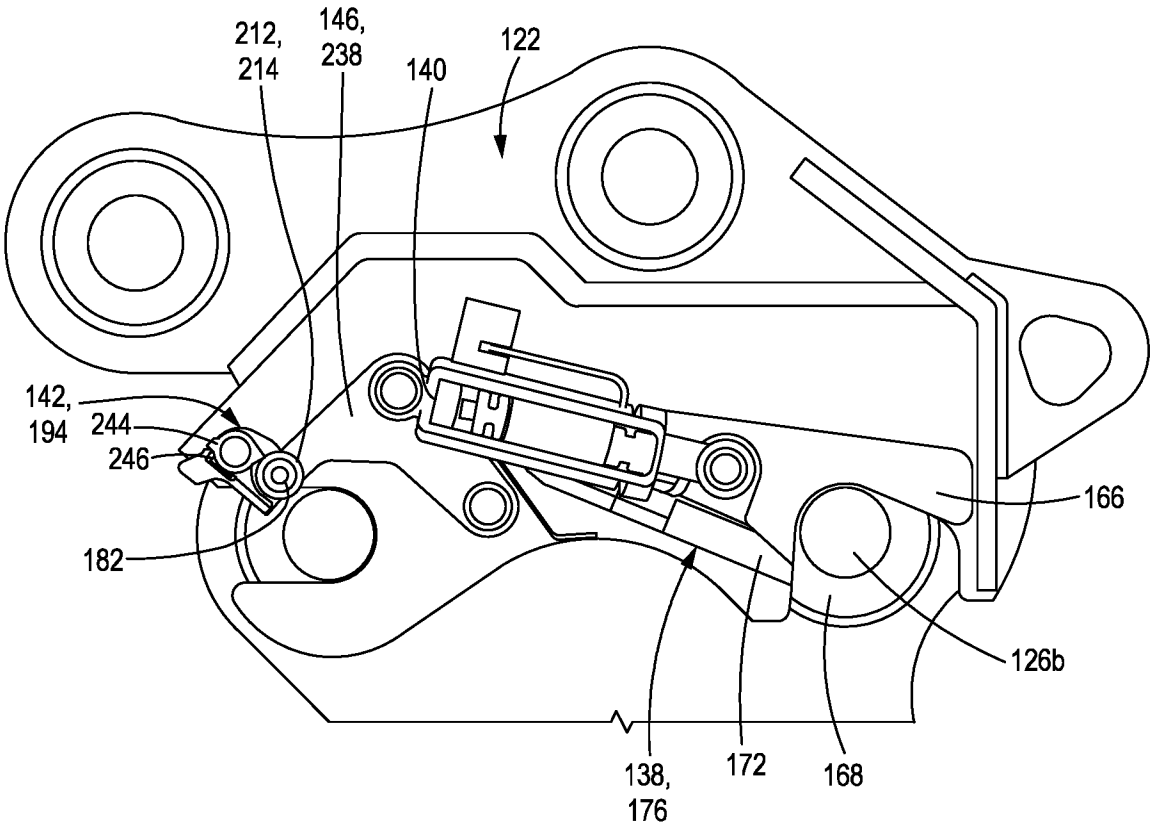
FIG. 11 illustrates the tertiary lock in the locked TL position, the lock of the secondary lock assembly in the locked SL position and the primary lock in an unlocked PL position.

The secondary lock assembly is illustrated in FIG. 4. The secondary lock assembly 142 is disposed on the frame 136 and may comprise a lock 180, a rocker shaft 182 and a pivot shaft 184. The lock 180 may have one or more ends, for example, the lock 180 may have a first end 188 and a second end 190, as shown in FIG. 4. The lock 180 includes a first shoe portion 186*a* disposed at the first end 188 and a second shoe portion 186*b* disposed at the second end 190, each of the first shoe portion 186*a* and the second shoe portion 186*b* disposed on the pivot shaft 184 that extends along the pivot axis P. The second shoe portion 186*b* may be disposed opposite to the first shoe portion 186*a*. The lock 180 may be pivotable about the pivot shaft 184 and the pivot axis P between an unlocked SL position 192 (FIG. 5) and a locked SL position 194 (FIG. 10). The pivot shaft 184 is mounted or coupled to the first sidewall 154*a* (FIG. 4) and to the second sidewall 154*b* of the cavity 150. The pivot shaft 184 is disposed between the first shoe portion 186*a* and the second shoe portion 186*b*. The rocker shaft 182 (FIG. 4 and FIG. 10) is disposed between the first shoe portion 186*a* (FIG. 4) and the second shoe portion 186*b* and extends along a rocker axis R. The rocker shaft 182 is moveable relative to the first sidewall 154*a* and second sidewall 154*b* because the rocker shaft 182 is connected to the rocker frame 146. In some embodiments, the pivot shaft 184 may be fixed in position and may be generally parallel to the rocker shaft 182. In an embodiment, the rocker shaft 182 may be disposed inside a detent 212.

The actuator 140 may be further configured to activate movement of the lock 180 about the pivot shaft 184 and the pivot axis P from an unlocked SL position 192 (FIG. 5) to a locked SL position 194 (FIG. 10) and vice versa. In the unlocked SL position 192, the lock 180 is disposed so as to not block the first tool pin 126*a* from being received by the concavity 162 or released from the concavity 162 of the hook 160. In the locked SL position 194, the lock 180 is positioned in the concavity 162 to block the first tool pin 126*a* from being released from (or received by) the concavity 162. The pivot axis P is oriented in a generally horizontal direction across the frame 136.

The rocker frame 146 (FIG. 4) is pivotally disposed on the frame 136 between the first sidewall 154*a* and the second sidewall 154*b* and is operably connected to the actuator 140. The rocker frame 146 may include one or more arms 195 operably connected to the rocker shaft 182. The rocker frame 146 may couple the rocker shaft 182 to the actuator 140. The arms 195 may be disposed between and adjacent to the first shoe portion 186*a* and the second shoe portion 186*b*. The rocker frame 146 is configured to be pivotable from a rocker release position 236 (shown in FIGS. 7-8) to a rocker hold position 238 (shown in FIG. 9) and vice versa.

The tertiary lock 148 is disposed between the first end 188 and the second end 190 of the lock 180 of the secondary lock assembly 142 and may be disposed adjacent to the rocker frame 146. The tertiary lock 148 is moveable between a locked TL position 196 (FIG. 5) to an unlocked TL position 198 (FIG. 12) and vice versa. The tertiary lock 148 (FIG. 4) may include a first shoulder 200, a second shoulder 202, a leg 204 (best seen in FIG. 5), a tab 206 (FIG. 4), a latch 208, one or more bias members 210 and a detent 212. The tertiary lock 148 is configured to automatically lock onto a tool 124 without use of an actuator (e.g., a dedicated hydraulic actuator). In the locked TL position 196, the leg 204 is disposed to block release of a first tool pin 126*a* from the concavity 162 (the leg 204 is disposed in the concavity 162 between the entrance 164 and the first tool pin 126*a*). In the unlocked TL position 196, the leg 204 is disposed (e.g., outside or substantially outside of the concavity 162) so that the leg 204 does not block release of the first tool pin 126*a* from the concavity 162 and does not block movement of the first tool pin 126*a* within the concavity 162.

Figure 12:
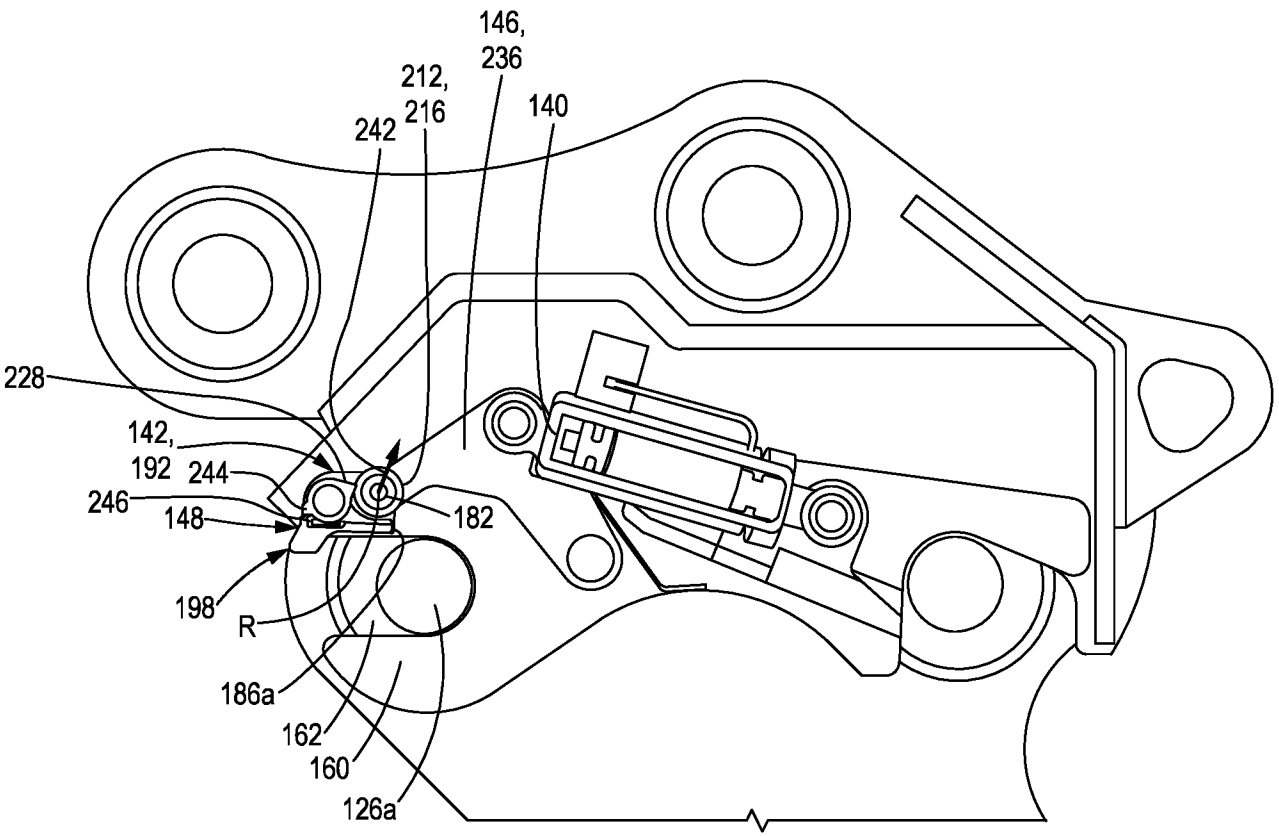
FIG. 12 illustrates the tertiary lock in the unlocked TL position, the lock of the secondary lock assembly in the unlocked SL position and the primary lock in an unlocked PL position.
Figure 13:
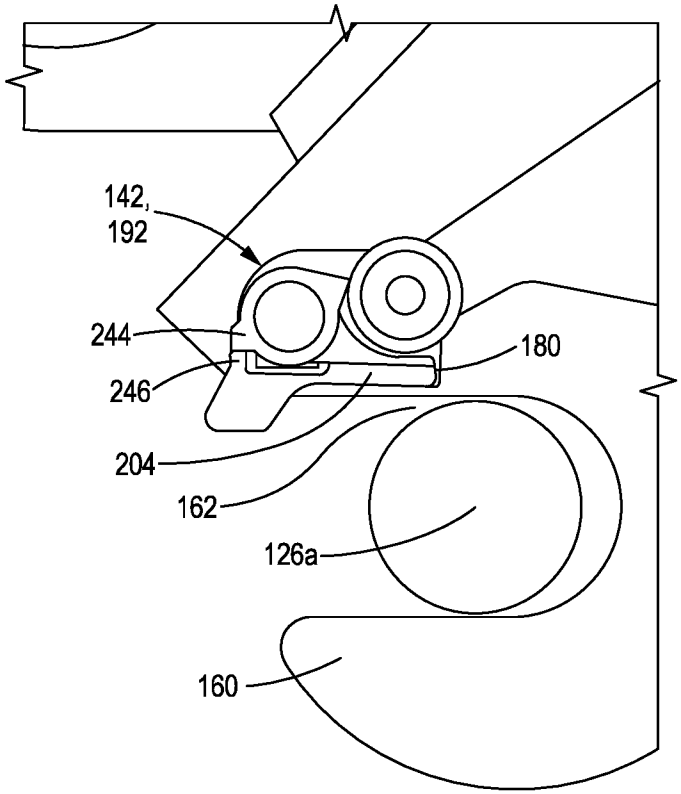
FIG. 13 is an enlargement of a portion of FIG. 12.

The first shoulder 200 is disposed on the pivot shaft 184 (and the pivot axis P) between the first end 188 and the second end 190 of the lock 180 of the secondary lock assembly 142. The second shoulder 202 is disposed on the pivot shaft 184 (and the pivot axis P) between the first end 188 and the second end 190 of the lock 180 of the secondary lock assembly 142, and is spaced apart from the first shoulder 200. The tertiary lock 148 is configured to pivot the first shoulder 200 and the second shoulder 202 (about the pivot shaft 184 and the pivot axis P) during movement of the detent 212 from a hold position 214 (FIG. 9) to a release position 216 (FIG. 12).

The leg 204 (FIGS. 4-5) is disposed between and connects the first shoulder 200 (FIG. 4) and the second shoulder 202. The tertiary lock 148 is further configured to pivot the leg 204 (FIG. 5) (with the lock 180) about the pivot shaft 184 and the pivot axis P (e.g., during movement of the detent 212 from a hold position 214 (FIG. 9) to a release position 216 (FIG. 12) caused by pivoting movement of the supporting rocker frame 146 by actuator 140). The leg 204 may include a rest member 246 that is disposed proximal to the tab 206 and that projects outward toward the stop 244.

Figure 14:
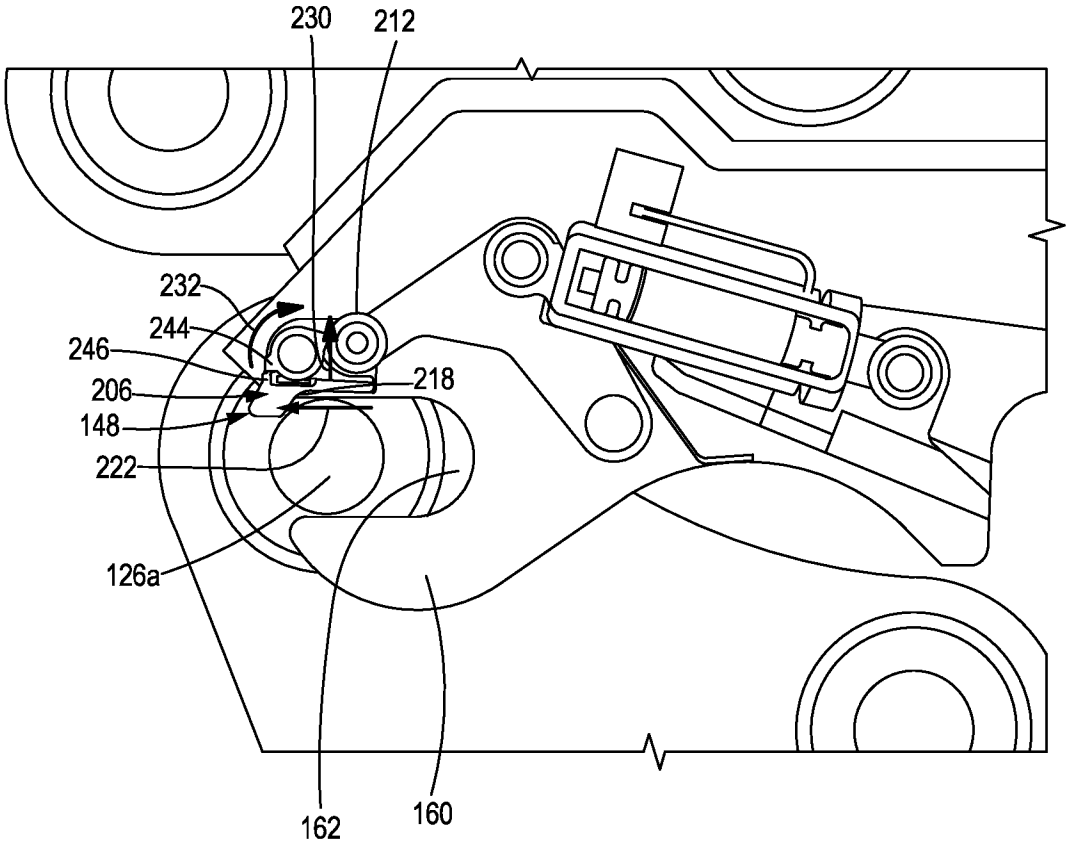
FIG. 14 illustrates the first tool pin exiting the concavity of the hook.

The tab 206 (FIGS. 4-5) projects outward from the leg 204. The tab 206 is pivotable (about the pivot shaft 184 and the pivot axis P) (e.g., during movement of the detent 212 from a hold position 214 (FIG. 9) to a release position 216 (FIG. 6)). The tab 206 includes a back face 218 and a bottom face 220. The tab 206 is configured to move the tertiary lock 148 into the locked TL position 196 when the lock 180 of the secondary lock assembly 142 is in the unlocked SL position 192 and the first tool pin 126*a* while exiting the concavity 162 of the hook 160 exerts a pin force 222 (FIG. 14) on the back face 218. In an embodiment, the contour of the back face 218 may be complementary to the contour of the first tool pin 126*a*. For example in one embodiment, as shown in FIG. 14, the back face 218 of the tab 206 may be convex in shape. In another scenario illustrated in FIG. 16, the tab 206 may be further configured to move the tertiary lock into the locked TL position 196 (FIG. 5) when the lock 180 of the secondary lock assembly 142 is in the unlocked SL position 192 and the first tool pin 126*a* exerts a reset force 224 (FIG. 16) on the bottom face 220 (such reset force 224 causes the tab 206 to pivot about pivot axis P). To help facilitate this the tab 206 is oriented at an (obtuse) angle θ from the leg 204, with the bottom face 220 disposed outside of the entrance 164 to the hook 160 so as to enable the first tool pin 126*a* to be better positioned to reset the tertiary lock 148 without interference from the end of the hook 160.

Figure 5:
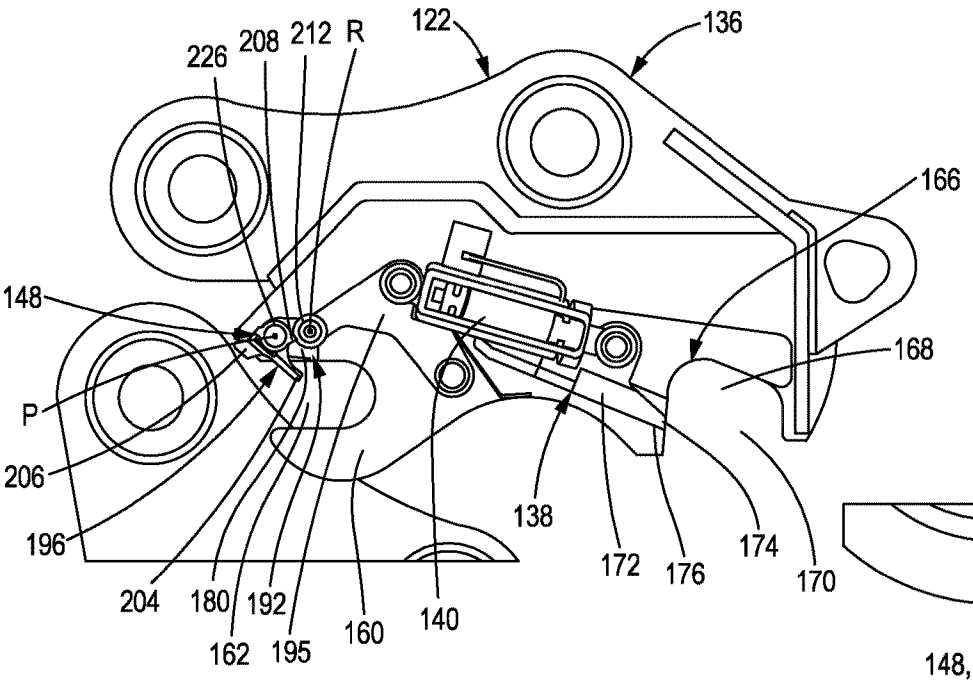
FIG. 5 is a cutaway side view of the pin grabber coupler illustrating the primary lock in an unlocked PL position and the secondary lock assembly in the unlocked SL position and the tertiary lock in the locked TL position.

The latch 208 (FIG. 4) is disposed on the pivot shaft 184 between the first shoulder 200 and the second shoulder 202, and is pivotable about the pivot shaft 184 and the pivot axis P. The latch 208 includes a body 226 and a catch 228 (FIG. 5). The body 226 extends along the pivot axis P. The catch 228 projects outward from the body 226. The latch 208 may further include a stop 244. The stop 244 may protrude from the body 226 and in an exemplary embodiment may be disposed opposite to the catch 228. The stop 244 may be configured to engage the rest member 246 (received against the stop 244).

The one or more bias members 210 (FIG. 4) may be disposed on the pivot shaft 184 and the pivot axis P and are each configured to exert a biasing force on the tertiary lock 148 to urge the tertiary lock 148 to the locked TL position 196. The bias member 210 may be a torsional spring or the like.

Figure 17:
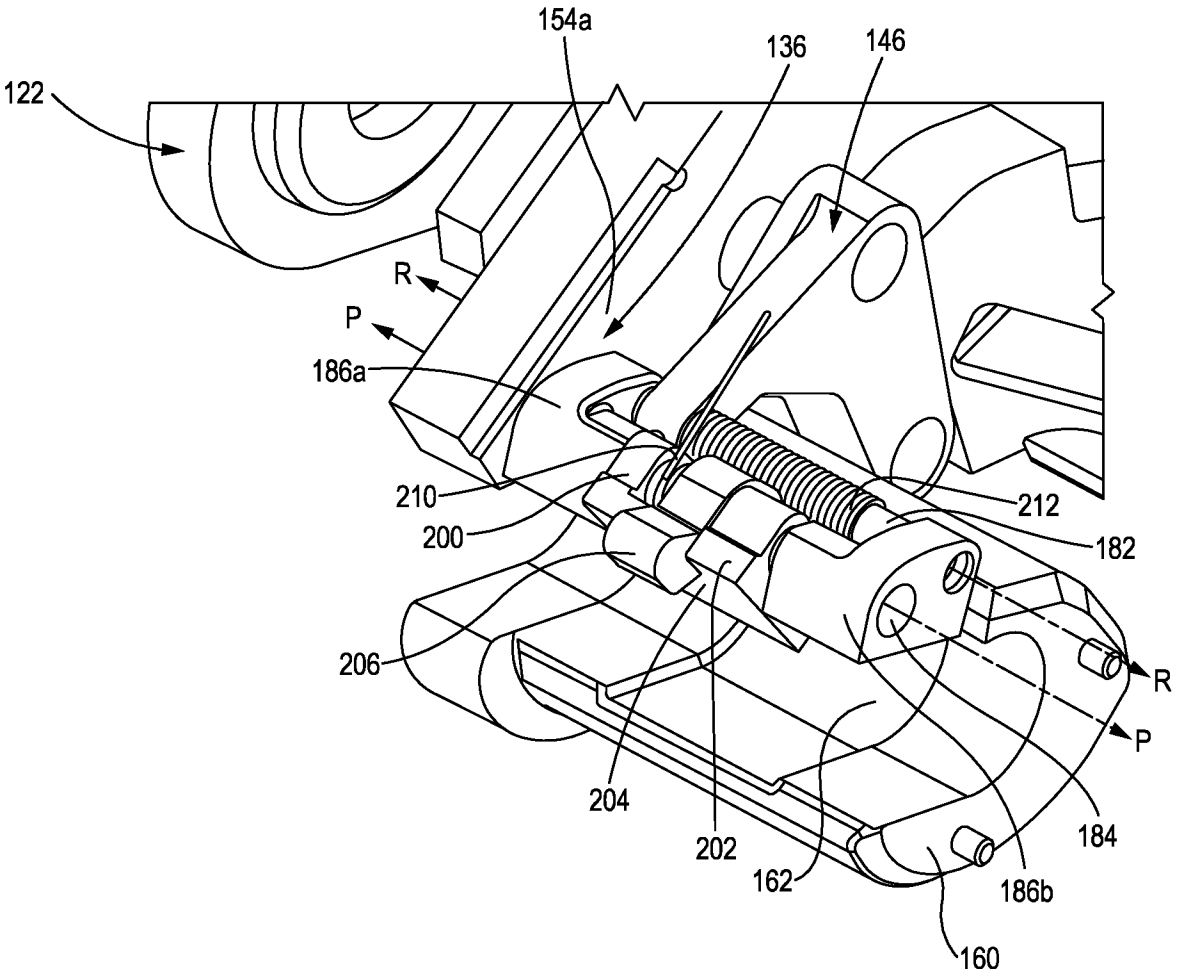
FIG. 17 illustrates another exemplary embodiment of the tertiary lock.

The detent 212 extends along a rocker axis R between the first end 188 and the second end 190 of the lock 180 of the secondary lock assembly 142. The detent 212 may be disposed on the rocker shaft 182 between a (first) arm 195 and a (second) arm 195 of the rocker frame 146. The detent 212 is pivotable between a hold position 214 (FIG. 9) and a release position 216 (FIG. 12). The detent 212 (FIG. 9) is configured to exert, when in the hold position 214, a holding force 230 against the latch 208 (via the catch 228) that is greater than the biasing force 232 exerted by the bias member 210 (FIG. 4). When the detent 212 is in the release position 216 (FIG. 6), the holding force 230 applied by the detent 212 against the latch 208 is less than the biasing force 232 applied by the bias member 210. The detent 212 may be a spring, a barrel spring or the like. In the embodiment of FIG. 12 (and as can be seen in FIG. 4) the detent 212 is a barrel spring that extends radially outward from the rocker shaft 182 and rocker axis R, with the middle portion of the barrel spring extending further radially outward from the rocker shaft 182 and rocker axis R than the end portions. In yet another embodiment of the pin grabber coupler 122 shown in FIG. 17, the detent 212 is, instead of a barrel spring, a coil spring with a relatively constant diameter.

Figure 18:
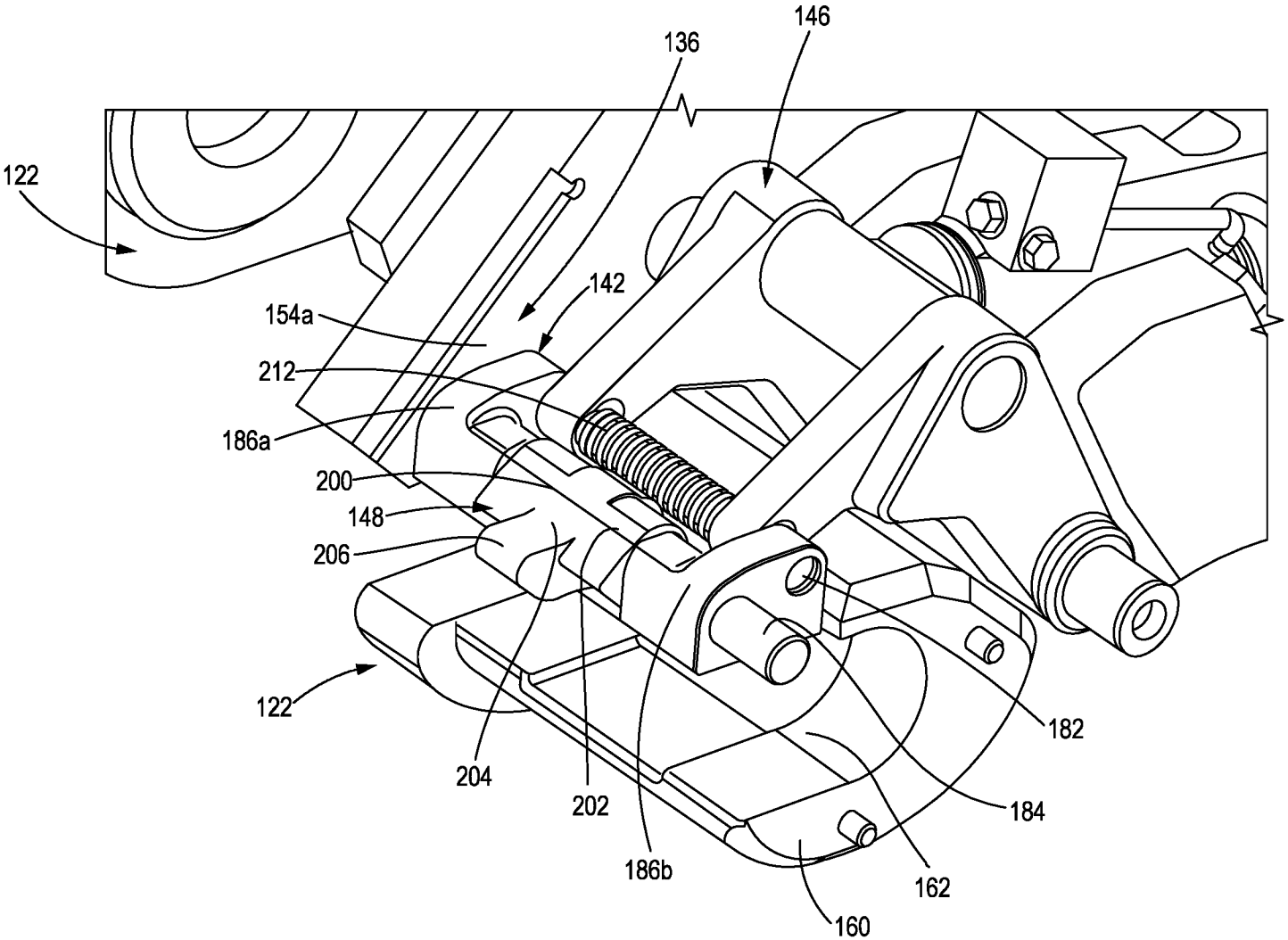
FIG. 18 illustrates another exemplary embodiment of the tertiary lock.

In some embodiments, although not all embodiments, a plurality of elements of the tertiary lock 148 may be integral. For example, the leg 204 and the tab 206 may be integral. In other embodiments, such as the embodiment shown in FIG. 18, the first shoulder 200, the second shoulder 202, the leg 204, the tab 206 and the latch 208 may be integral. Other combinations are also envisioned.

Also disclosed is a method of locking a tool 124 to a pin grabber coupler 122 on a machine 100. In an embodiment, the method may comprise: locking the tool 124 to the pin grabber coupler 122 with the tertiary lock 148, wherein activation of the tertiary lock 148 is triggered by the first tool pin 126*a* entering the concavity 162, displacing the tertiary lock 148 against the biasing force of biasing member 210 as first tool pin 126*a* moves into the concavity past the tertiary lock and exerts a pin activation force 234 on the tertiary lock 148; when the tool 124 is locked to the pin grabber coupler 122 by the tertiary lock 148, activating the secondary lock assembly 142 to move the lock 180 from an unlocked SL position 192 to a locked SL position 194, wherein when in the locked SL position 194, the lock 180 blocks the first tool pin 126*a* from being released from or received by the concavity 162, and when in the unlocked SL position 192 the lock 180 does not block the first tool pin 126*a* from being received by the concavity 162 of the hook 160 or released from the hook 160.

Also disclosed is a method of unlocking a tool 124 from a pin grabber coupler 122 on a machine 100. In an embodiment, the method may comprise: pivoting the detent 212 from the hold position 214 to the release position 216 and unlocking the lock 180 by pivoting the lock 180 out of the concavity 162, wherein when the detent 212 is in the release position 216, the tertiary lock 148 is unlocked.

INDUSTRIAL APPLICABILITY

In general, the foregoing disclosure finds utility in machines 100 having interchangeable tools, for example excavators 102, that have a tool 124 that is interchangeable and is releasably locked to the machine 100. The disclosed pin grabber coupler 122 here is particularly useful for picking up tools 124 that are located farther away or at a higher elevation relative to the machine 100. Typically, in such a case the operator must reposition the tool 124 or the machine 100 in order to be able to pick up the tool 124 without risking the tool 124 slipping out during the locking process. Also, tools 124 that sit on the ground with their tool pins 126 relatively level or have a center of gravity that is shifted toward the one of the tool pins 126 (e.g., the second tool pin 126*b*) can also be challenging to pick up. Herein is disclosed a pin grabber coupler 122 that is locked onto the tool 124 via the tertiary lock 148 before the operator begins the locking process for the primary lock 138 and the lock 180 of the secondary locking assembly 142, thereby ensuring that the tool 124 does not slip out before the locking process is complete for the primary lock 138 and the lock 180 of the secondary lock assembly 142.

Figure 20:
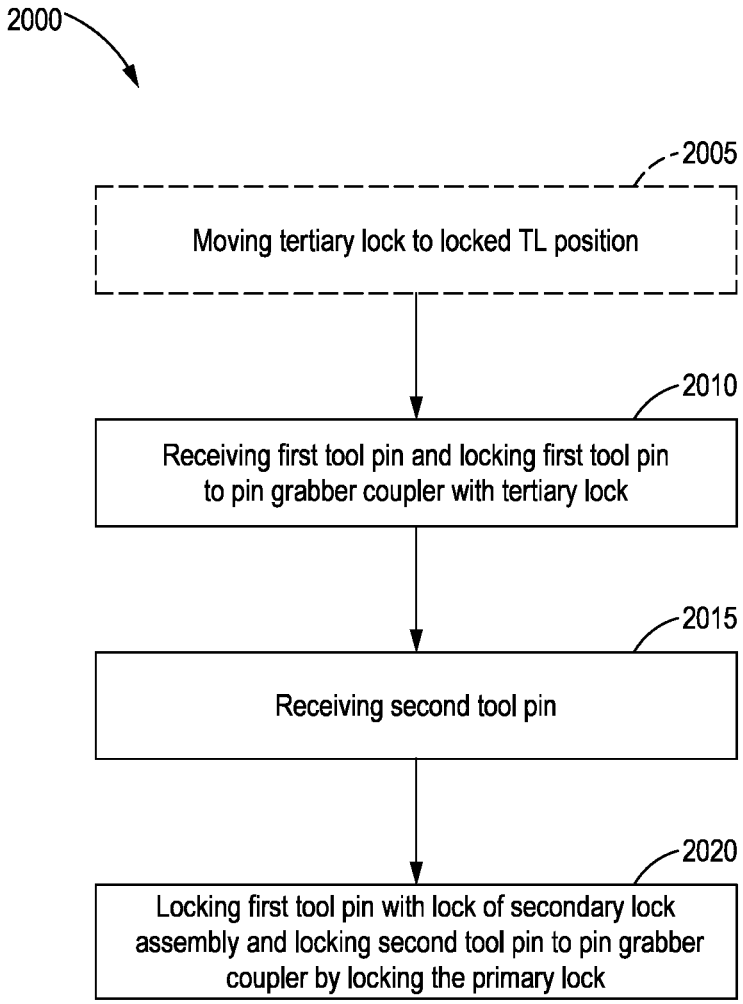
FIG. 20 illustrates blocks of an exemplary method according to this disclosure.

Referring now to FIG. 20 an exemplary flowchart is illustrated showing sample blocks which may be followed in a method 2000 of locking a tool 124 to the pin grabber coupler 122 on a machine 100. In this exemplary method 2000, the primary lock 138 may start in the unlocked PL position 176 and the lock 180 of the secondary lock assembly 142 may be in the unlocked SL position 192. The tertiary lock 148 may start in either the locked TL position 196 or the unlocked TL position 198.

The method 2000 may optionally include block 2005, namely, moving the tertiary lock 148 to the locked TL position 196 if the current position of the tertiary lock 148 is the unlocked TL position 198. The tertiary lock 148 may be in the unlocked TL position 198 without a first tool pin 126*a* contained in the concavity 162 when, for example, an operator has previously locked and then unlocked the lock 180 of the secondary lock assembly 142 (moved the lock 180 from the locked SL position 194 to the unlocked SL position 192) without a first tool pin 126*a* having been (installed) in the concavity 162 of the pin grabber coupler 122. Moving the tertiary lock 148 to the locked TL position 196 in block 1905 includes positioning the first tool pin 126*a* below the bottom face 220 of the tab 206 and moving the first tool pin 126*a* in a generally upward direction against the bottom face 220, as shown for example in FIG. 16. The force exerted against the bottom face 220 of the tab 206 (the "reset force" 224) by the first tool pin 126*a* resets the tertiary lock 148 back to the locked TL position 196 by causing (the tab 206 and) the leg 204 of the tertiary lock 148 to pivot about the pivot axis P, which moves the leg 204 into the concavity 162 of the hook 160 to the locked TL position 196 as shown in FIG. 5. Block 2005 may be skipped when the current position of the tertiary lock 148 is the locked TL position 196.

Figure 6:
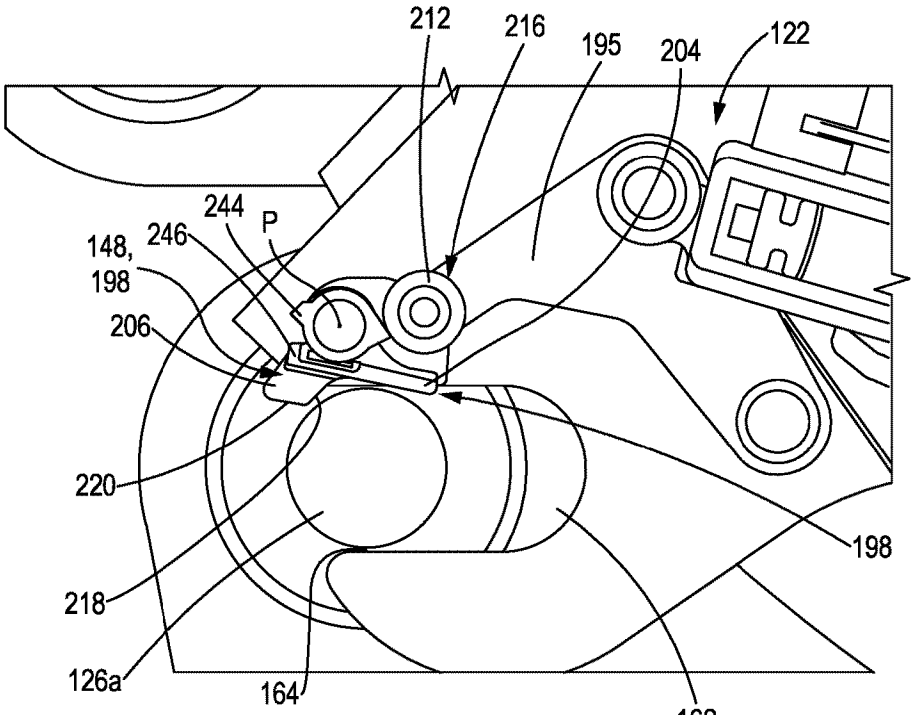
FIG. 6 is an enlargement of a portion of the pin grabber coupler.
Figure 8:
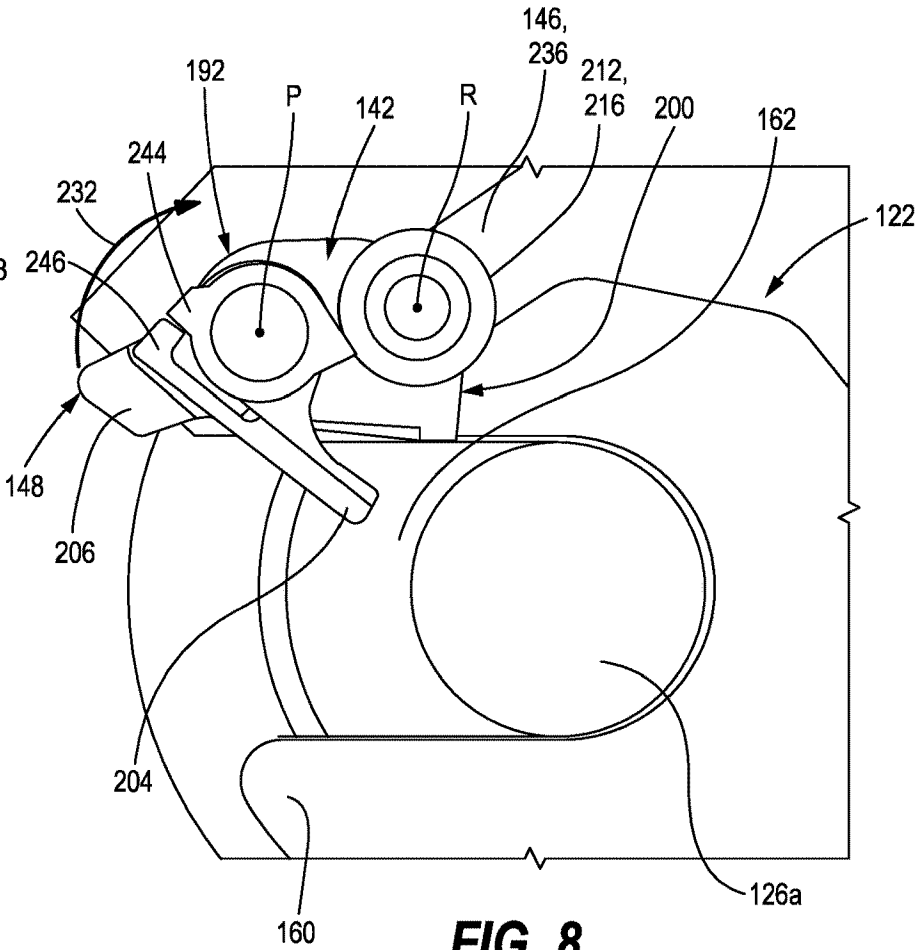
FIG. 8 illustrates an enlargement of a portion of FIG. 7.
Figure 7:
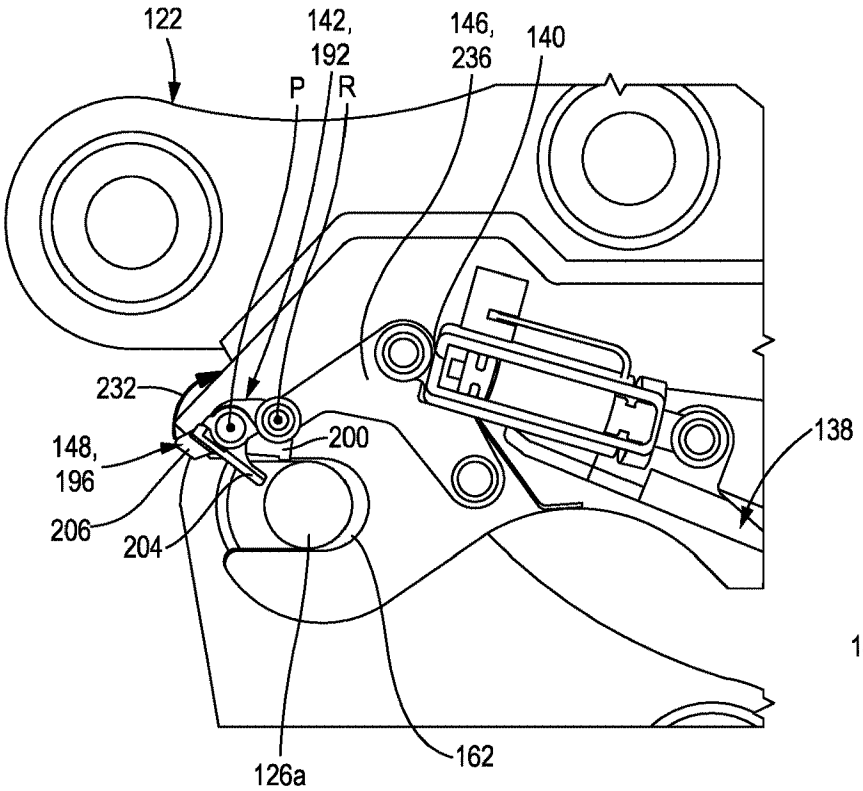
FIG. 7 illustrates the tertiary lock in the locked TL position and the lock of the secondary lock assembly in the unlocked SL position and the rocker frame is in a rocker release position.
Figure 19:
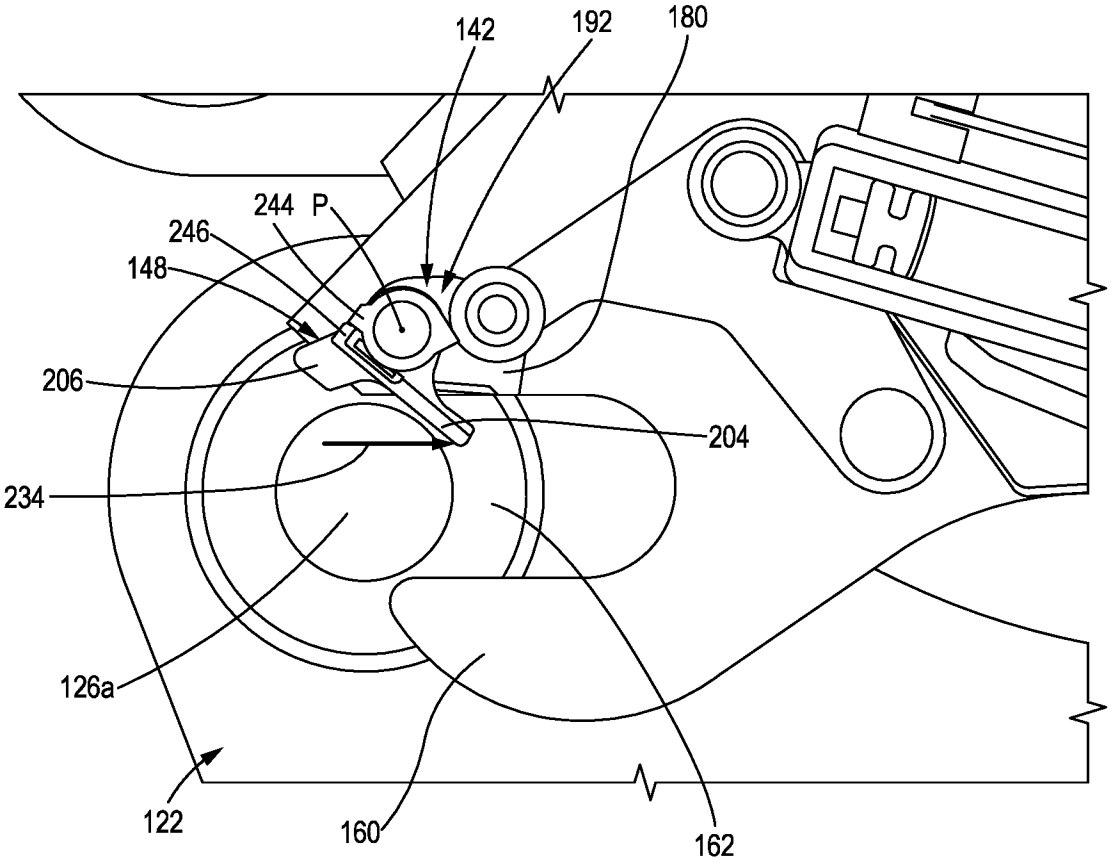
FIG. 19 illustrates activation of the tertiary lock triggered by the first tool pin entering the concavity.

In block 2010, the method 2000 includes locking the tool 124 to the pin grabber coupler 122 with the tertiary lock 148, wherein activation of the tertiary lock 148 is triggered by the first tool pin 126*a* entering the concavity 162 and exerting a force (a "pin activation force" 234) on the leg 204 of the tertiary lock 148 (see FIG. 19) that pivots the leg 204 (about the pivot axis P) upward and at least substantially out of the concavity 162 such that the leg 204 does not interfere with the movement of the first tool pin 126*a* further (deeper) into the concavity 162. This activation of the tertiary lock 148 is different than activation of a locking mechanism by a dedicated actuator such as a hydraulic cylinder or the like, without which the locking mechanism would not be activated. This activation is triggered by the first tool pin 126*a* (of the tool 124 to be coupled to the machine 100) engaging the leg 204 of the tertiary lock 148. As the first tool pin 126*a* enters the entrance 164 and moves into the concavity 162, the first tool pin 126*a* engages the portion of the leg 204 that extends into the concavity 162 of the hook 160 when the tertiary lock 148 is in the locked TL position 196. The first tool pin 126*a* moving inward (into the concavity 162) pushes against the leg 204 (the pin activation force 234) and moves the tertiary lock 148 into the unlocked TL position 198 by pivoting (e.g., counterclockwise) the leg 204, the first shoulder 200, the second shoulder 202 and the tab 206 about the pivot axis P such that the leg 204 moves out (or at least substantially out) of the concavity 162, the rest member 246 pivots away from the stop 244 (of the latch 208) and the tab 206 moves toward the entrance 164, as shown in FIG. 6. As illustrated in FIG. 6, the leg 204 no longer blocks or interferes with the movement of the first tool pin 126*a* into the concavity 162 and the first tool pin 126*a* is free to move further into the concavity 162.

Once the first tool pin 126*a* slides inward and is received in the deeper in the concavity 162 where the first tool pin 126*a* is no longer "holding" the leg 204 and tertiary lock 148 in the unlocked TL position 198, block 2010 further includes moving the tertiary lock 148 (back) to the locked TL position 196 (FIGS. 7-8) via the biasing force 232 exerted by the bias member 210 (e.g., the torsional spring) (see FIG. 4) on the leg 204 (FIGS. 7-8), first shoulder 200, second shoulder 202 (FIG. 4) and the tab 206 (FIGS. 7-8) of the tertiary lock 148. This pivots (e.g., clockwise) the leg 204 into the concavity 162 and pivots the rest member 246 toward the stop 244 so that the leg 204 is now disposed in the concavity 162 between the entrance 164 and the first tool pin 126*a*, and the tab 206 (which has also pivoted clockwise) is disposed out of the entrance 164. The tool 124 (FIG. 1) (more specifically, the first tool pin 126*a*) is now locked to the pin grabber coupler 122 (FIGS. 7-8) by the tertiary lock 148, which prevents first tool pin 126*a* from moving out of the concavity 162 and thereby significantly reduces or eliminates the possibility of the tool 124 from slipping out of the pin grabber coupler 122 during subsequent locking of the secondary lock assembly 142 and the primary lock 138.

In block 2015, the method 2000 may further include receiving the second tool pin 126*b* into the chamber 168 of the notch 166 via the mouth 170.

Figure 9:
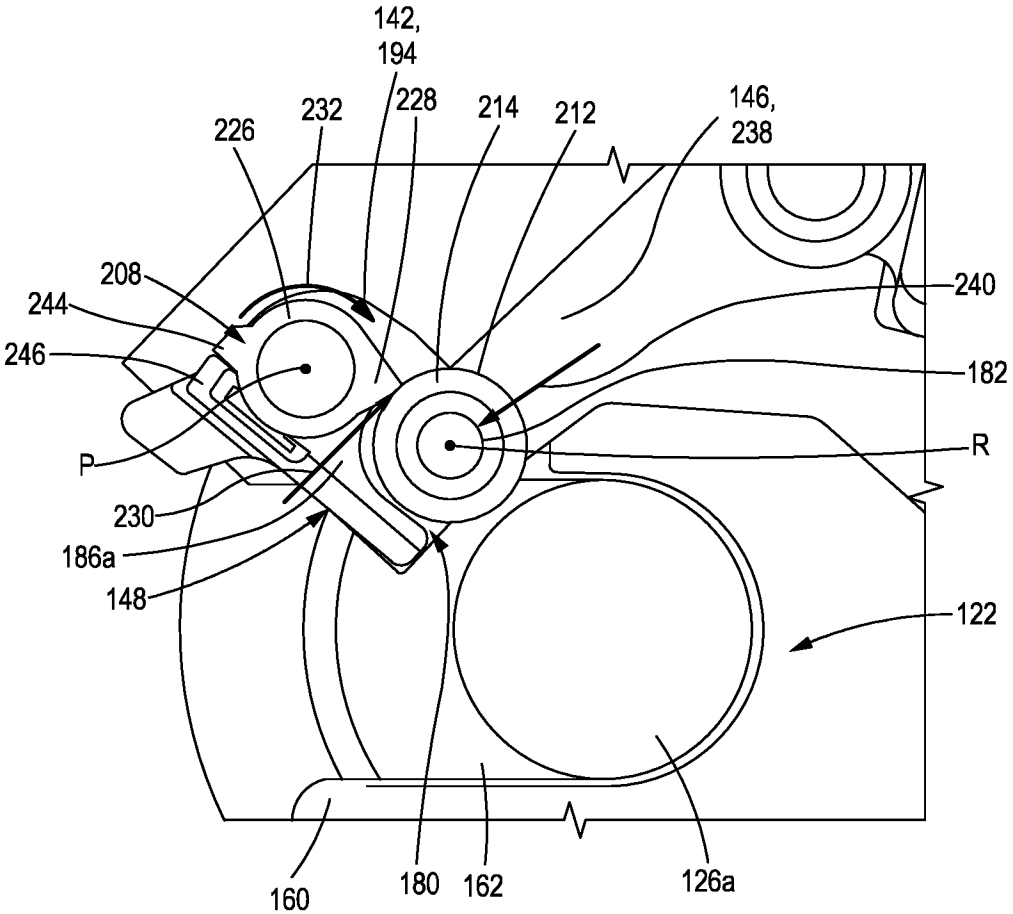
FIG. 9 illustrates the tertiary lock in the locked TL position and the lock of the secondary lock assembly in the locked SL position and the rocker frame in a rocker hold position.

In block 2020, the method 2000 may further include locking the first tool pin 126*a* with the lock 180 by moving (by the actuator 140) the lock 180 from the unlocked SL position 192 (shown in FIGS. 7-8) to the locked SL position 194 (shown in FIG. 9). In the embodiment shown in FIGS. 7-9, the actuator 140 (FIG. 7) is a hydraulic cylinder that causes the rocker frame 146 to pivot from a rocker release position 236 (shown in FIGS. 7-8) to a rocker hold position 238 (shown in FIG. 9), and, by doing so, also moves the detent 212 (FIG. 8) from a release position 216 to a hold position 214 (FIG. 9). When the rocker frame 146 moves to the rocker hold position 238, the rocker frame 146 exerts a rocker activation force 240 on the rocker shaft 182 of the secondary lock assembly 142, thereby driving the first shoe portion 186*a* and the second shoe portion 186*b* (which are connected to the rocker shaft 182) into the concavity 162 of the hook 160. This moves the lock 180 into the locked SL position 194 in which the first shoe 186*a* and second shoe 186*b* of the lock 180 are disposed to block the first tool pin 126*a* from being released from the concavity 162 of the hook 160, as shown in FIG. 9.

The movement of the rocker frame 146 to the rocker hold position 238 forces the detent 212 to the hold position 214, in which the detent 212 exerts a holding force 230 on the latch 208. More specifically, this movement forces the detent 212 past the catch 228 and creates an interference-type fit between the detent 212 and the catch 228 of the latch 208, which has the effect of "joining" the pivotable portion of the tertiary lock 148 to the lock 180 of the secondary lock assembly 142 so that they pivot together when the lock 180 is moved to the unlocked SL position 192 (so long as the holding force 230 exerted on the latch 208 is greater than the biasing force 232 applied by the bias member 210 (best seen in FIG. 4 (e.g., torsional spring)). When so joined, the leg 204 (and tab 206, first shoulder 200 and second shoulder 202) of the tertiary lock 148 will move with the lock 180 (and the rocker shaft 182) of the secondary lock assembly 142. The method 2000 may further include activating the primary lock 138 to lock (secure) the second tool pin 126*b* to the pin grabber coupler 122 by extending the blocking member 172 into the chamber 168 of the notch 166 so that release of the second tool pin 126*b* via the mouth 170 is blocked by the blocking member 172, as shown in FIG. 10.

It may be desirable to perform one or more of the blocks shown in FIG. 20 in an order different from that depicted.

Figure 21:
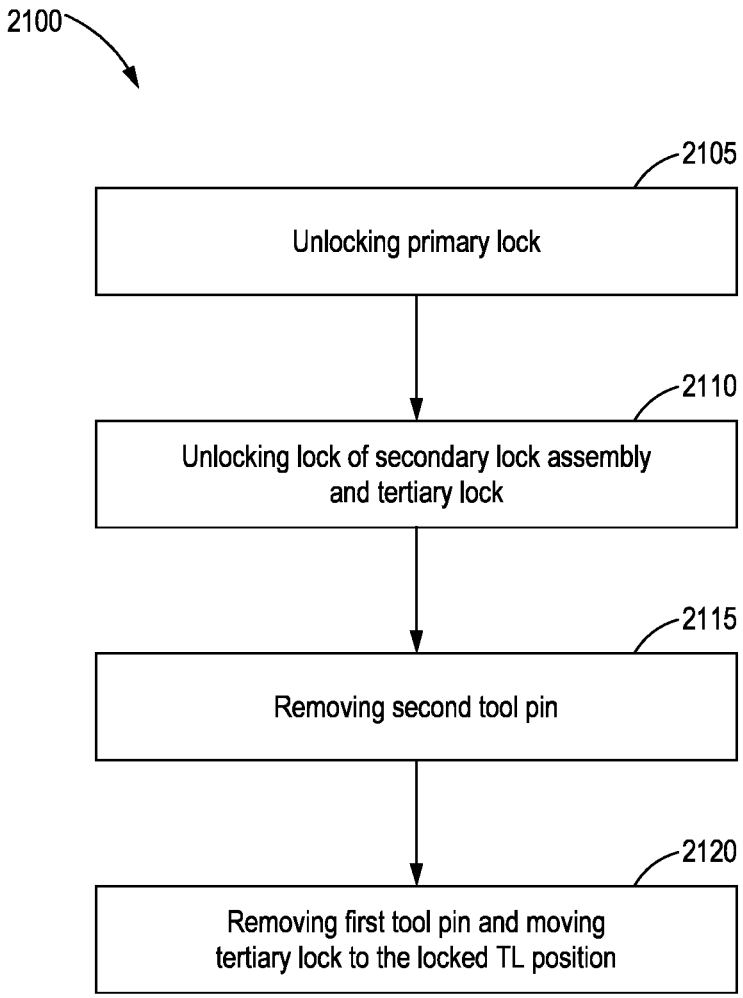
FIG. 21 illustrates blocks of another exemplary method according to this disclosure.

Referring now to FIG. 21 an exemplary flowchart is illustrated showing sample blocks which may be followed in a method 2100 of unlocking the tool 124 (FIG. 1) from the pin grabber coupler 122 on a machine 100. In this method, the primary lock 138 starts in the locked PL position 178 and the lock 180 of the secondary lock assembly 142 is in the locked SL position 194, as shown in FIG. 10. The tertiary lock 148 is in the locked TL position 196.

In block 2105, the process includes unlocking the primary lock 138 (FIG. 11) by moving (by the actuator 140) the primary lock 138 from the locked PL position 178 to the unlocked PL position 176. To unlock the primary lock 138, the actuator 140 causes the blocking member 172 to be retracted out of the chamber 168 of the notch 166 so that the second tool pin 126*b* of the tool 124 (FIG. 2) is not blocked by the blocking member 172 (FIG. 11) from being released from the notch 166.

In block 2110, the method 2100 further includes unlocking the lock 180 (FIG. 12) of the secondary lock assembly 142 by moving (by the actuator 140) the lock 180 from the locked SL position 194 (FIG. 11) to the unlocked SL position 192 (FIG. 12). In the exemplary embodiment shown in FIGS. 11-12, the actuator 140 is a hydraulic cylinder that causes the rocker frame 146 to pivot from the rocker hold position 238 (FIG. 11) to the rocker release position 236 shown in FIG. 12 and at same time pivots the detent 212 (FIG. 11) from the hold position 214 to the release position 216 (FIG. 12). When the rocker frame 146 moves to the rocker release position 236, the rocker frame 146 exerts a rocker deactivation force 242 on rocker shaft 182, thereby driving the first shoe portion 186*a* and second shoe portion 186*b* out of the concavity 162 of the hook 160 and pivoting the latch 208 and stop 244. This moves the lock 180 into the unlocked SL position 192 in which the first shoe portion 186*a* and the second shoe portion 186*b* are disposed so as to not block release of the first tool pin 126*a* from the concavity 162. Because the tertiary lock 148 and the lock 180 of the secondary lock assembly 142 are temporarily joined by the interference fit of the detent 212 and catch 228, the first shoulder 200 and second shoulder 202 and leg 204 of the tertiary lock 148 move with the lock 180 to pivot out of the concavity 162 of the hook 160 so that release of the first tool pin 126*a* from the concavity 162 is not blocked (see FIGS. 12-13) by the leg 204 of tertiary lock 148.

In block 2115, the method 2100 includes removing the second tool pin 126*b* from the chamber 168.

Figure 15:
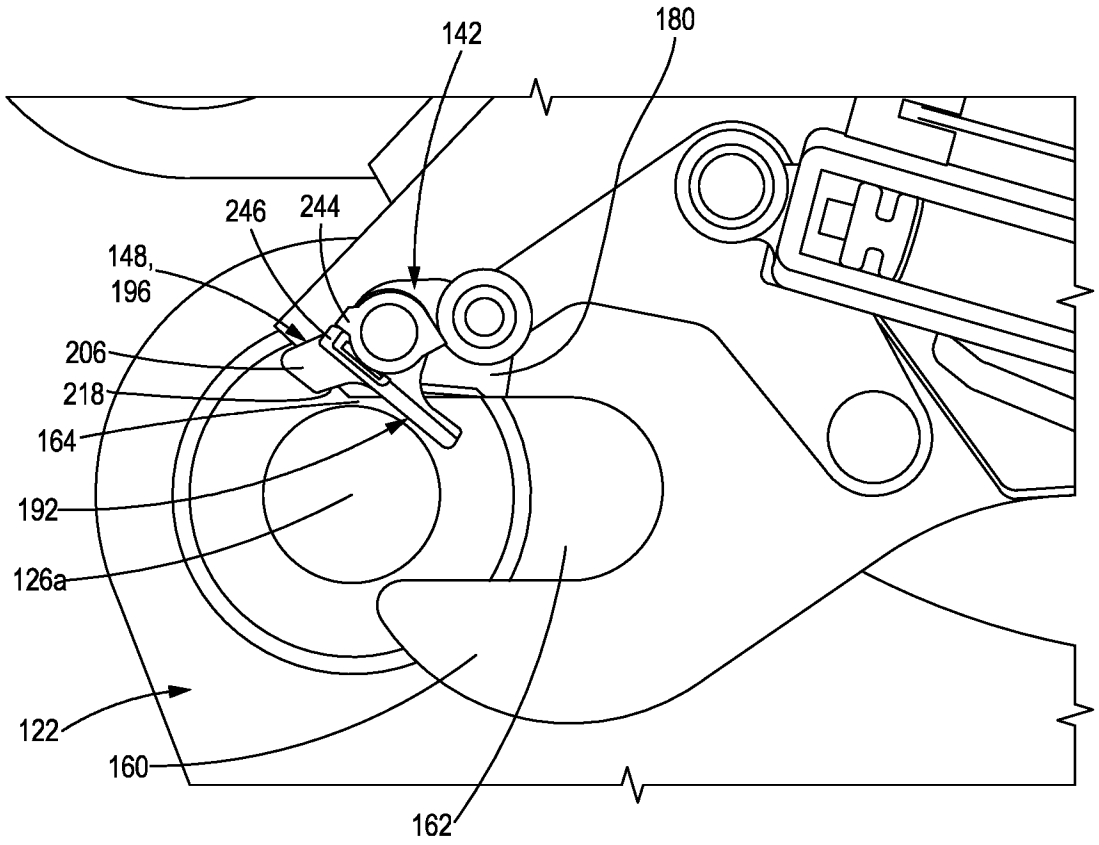
FIG. 15 illustrates moving the tertiary lock to the locked TL position.
Figure 16:
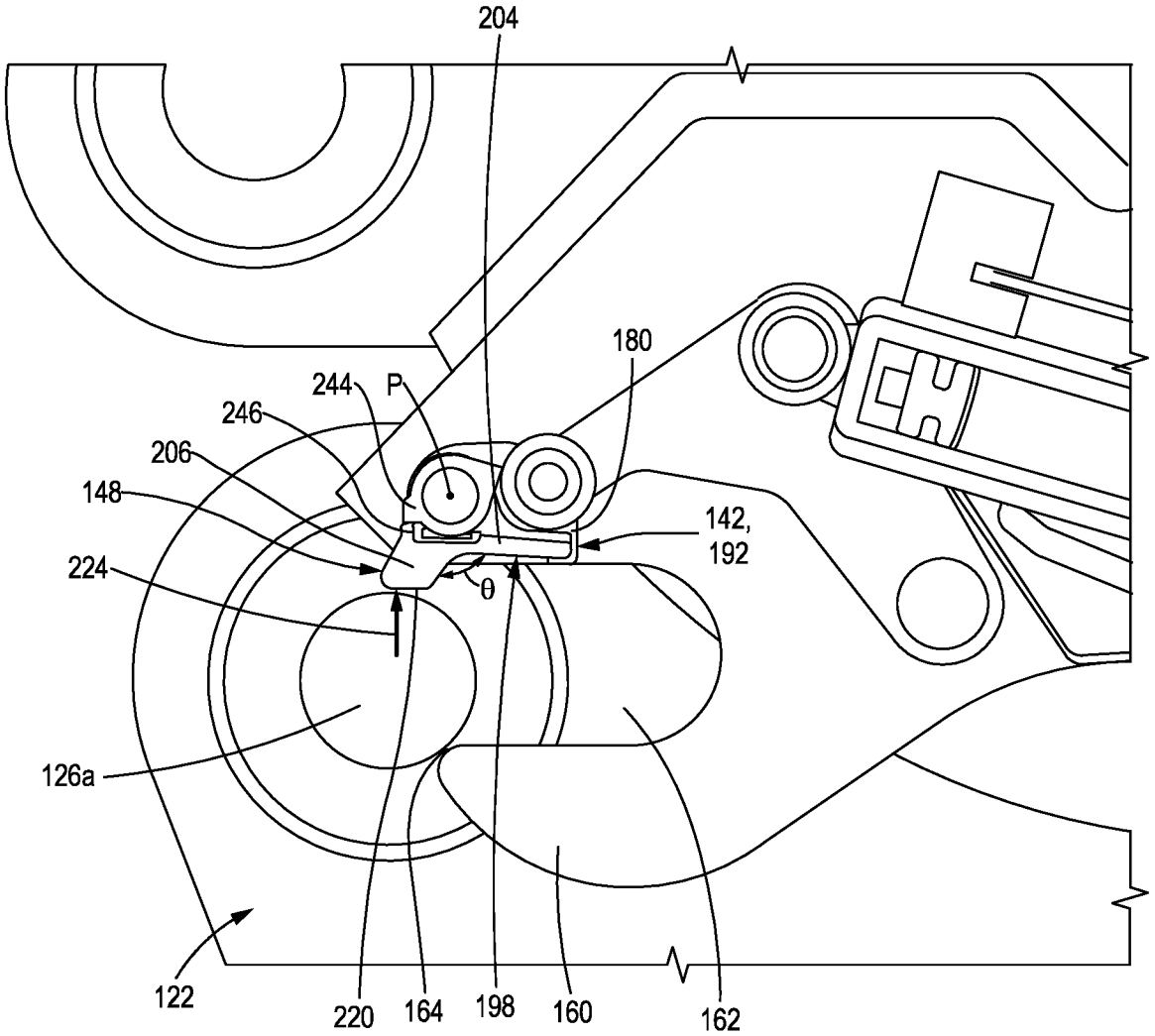
FIG. 16 illustrates resetting the tertiary lock during engagement of the first tool pin.

In block 2120, the method 2100 includes, removing the first tool pin 126*a* (FIG. 14) from the hook 160 and moving the tertiary lock 148 to the locked TL position 196 (FIG. 15). The first tool pin 126*a* is removed from the pin grabber coupler 122 by sliding the first tool pin 126*a* toward the tab 206 (or moving the coupler while the tool 124 having first tool pin 126*a* remains stationary), which is disposed just outside of the entrance 164 to the concavity 162 of the hook 160, as shown in FIG. 14. The tab 206 is shaped to contact the first tool pin 126*a* as the first tool pin 126*a* moves outside the entrance 164. Contact of the first tool pin 126*a* against the back face 218 of the tab 206 applies a pin force 222 against the tab 206 that, combined with the biasing force 232 of the bias member 210 (FIG. 4) overcomes that holding force 230 of the detent 212 and results in pivoting of the tab 206 about the pivot axis P (e.g., in a clockwise direction) to pivot the tab 206 out of the way of the first tool pin 126*a* and to lock the tertiary lock 148 (move into the locked TL position 196) by pivoting the leg 204 into the concavity 162 and pivoting the rest member 246, as shown in FIG. 15. The latch 208 pivots with the rest member 246.

It may be desirable to perform one or more of the blocks shown in FIG. 21 in an order different from that depicted.

From the foregoing, it will be appreciated that while only certain embodiments have been set forth for the purposes of illustration, alternatives and modifications will be apparent from the above description to those skilled in the art. These and other alternatives are considered equivalents and within the spirit and scope of this disclosure and the appended claims.

What is claimed is:

1. A pin grabber coupler for coupling a tool to a machine, the tool including a first tool pin, the pin grabber coupler comprising:

a frame that includes a hook, the hook defining a concavity having an entrance, the hook configured to receive the first tool pin in the concavity via the entrance;

a secondary lock assembly disposed on the frame, the secondary lock assembly including:

a lock pivotable about a pivot axis P between an unlocked SL position and a locked SL position, wherein when in the locked SL position, the lock is configured to block the first tool pin from being released from or received by the concavity, and when in the unlocked SL position the lock does not block the first tool pin from being received by the concavity of the hook or released from the hook; and a tertiary lock that extends along and is configured to pivot about the pivot axis P between an unlocked TL position and a locked TL position, the tertiary lock including:

a first shoulder disposed on the pivot axis P adjacent to the secondary lock assembly;

a second shoulder disposed on the pivot axis P, the second shoulder spaced apart from the first shoulder;

a leg disposed between the first shoulder and the second shoulder;

a tab projecting outward from the leg;

a latch including a body and a catch, the body extending along the pivot axis P, the catch projecting outward from the body;

a bias member disposed on the pivot axis P and configured to exert a biasing force on the tertiary lock to urge the tertiary lock to the locked TL position; and a detent extending along a rocker axis R, the detent moveable between a hold position and a release position, wherein the detent is configured to exert, when in the hold position, a holding force against the latch that is greater than the biasing force exerted by the bias member, wherein when the detent is in the release position, the holding force applied by the detent against the latch is less than the biasing force applied by the bias member.

2. The pin grabber coupler of claim 1, in which the frame further includes a notch that defines a chamber having a mouth, the notch configured to receive a second tool pin in the chamber via the mouth, the pin grabber coupler further comprising:

a primary lock disposed on the frame, the primary lock including a blocking member moveable between an unlocked PL position and a locked PL position, wherein, in the locked PL position, release of the second tool pin from the chamber of the notch is blocked by the blocking member, wherein in the unlocked PL position, the blocking member does not block the second tool pin from being received in the chamber of the notch and does not block the second tool pin from being released from the notch.

3. The pin grabber coupler of claim 1, wherein the detent is a spring.

4. The pin grabber coupler of claim 1, wherein the bias member is a torsional spring.

5. The pin grabber coupler of claim 1, wherein the first shoulder, second shoulder, the latch, the tab and the leg are integral.

6. The pin grabber coupler of claim 1, in which the tab includes a back face, the tab configured to move the tertiary lock into the locked TL position when the lock of the secondary lock assembly is in the unlocked SL position and the back face receives a pin force from the first tool pin exiting the concavity of the hook.

7. The pin grabber coupler of claim 1, in which the tab includes a bottom face, and the tab is configured to move the tertiary lock into the locked TL position when the lock of the secondary lock assembly is in the unlocked SL position and the bottom face receives a reset force from the first tool pin.

8. The pin grabber coupler of claim 1, wherein the tertiary lock is further configured to pivot the leg and with the lock during movement of the detent from the hold position to the release position.

9. A method of locking a tool to a pin grabber coupler on a machine, the tool including a first tool pin, the pin grabber coupler including a frame, a secondary lock assembly, and a tertiary lock, the frame including a hook, the hook defining a concavity having an entrance, the hook configured to receive the first tool pin in the concavity via the entrance, the secondary lock assembly including a lock, the method comprising:

locking the tool to the pin grabber coupler with the tertiary lock, wherein activation of the tertiary lock is triggered by the first tool pin entering the concavity and exerting a pin activation force on the tertiary lock; and when the tool is locked to the pin grabber coupler by the tertiary lock, activating the secondary lock assembly to move the lock from an unlocked SL position to a locked SL position, wherein when in the locked SL position, the lock is configured to block the first tool pin from being released from or received by the concavity, and when in the unlocked SL position the lock does not block the first tool pin from being received by the concavity of the hook or released from the hook, wherein:

the tertiary lock includes a leg and a bias member, the bias member configured to exert a biasing force on the tertiary lock to urge the tertiary lock to a locked TL position, wherein in the locked TL position the leg is disposed to block release of the first tool pin from the concavity, and the secondary lock assembly further includes a pivot shaft that extends along a pivot axis P, and in which locking the tool to the pin grabber coupler with the tertiary lock includes:

moving, by the first tool pin, the tertiary lock to an unlocked TL position by pivoting the leg about the pivot shaft and at least partially out of the concavity;

receiving the first tool pin further inside the concavity; and moving the tertiary lock to the locked TL position via the biasing force exerted by the bias member; and the tertiary lock includes:

a first shoulder disposed on a pivot axis P and adjacent to the secondary lock assembly;

a second shoulder disposed on the pivot axis P, the second shoulder spaced apart from the first shoulder;

a leg disposed between the first shoulder and the second shoulder;

a tab projecting outward from the leg;

a latch including a body and a catch, the body extending along the pivot axis P, the catch projecting outward from the body;

a bias member disposed on the pivot axis P and configured to exert a biasing force on the tertiary lock to urge the tertiary lock to a locked TL position; and a detent extending along a rocker axis R, the detent moveable between a hold position and a release position, wherein the detent is configured to exert, when in the hold position, a holding force against the latch that is greater than the biasing force exerted by the bias member; and wherein when the detent is in the release position, the holding force applied by the detent against the latch is less than the biasing force applied by the bias member.

10. The method of claim 9, in which the secondary lock assembly further includes a rocker shaft extending along the rocker axis R, and in which the pin grabber coupler further includes a rocker frame, wherein the rocker frame is coupled to the rocker shaft, wherein further the detent is disposed along the rocker shaft, the rocker axis R different than the pivot axis P.

11. The method of claim 10, wherein the rocker shaft is at least partially disposed inside the detent.

12. The method of claim 10 further comprising moving the tertiary lock to the locked TL position by exerting a reset force on a bottom face of the tab with the first tool pin prior to the first tool pin entering the concavity.

13. A method of unlocking a tool from a pin grabber coupler on a machine, the tool including a first tool pin, the pin grabber coupler including a frame, a rocker frame, a secondary lock assembly and a tertiary lock, the frame including a hook, the hook defining a concavity having an entrance, the hook configured to receive and to release the first tool pin in the concavity via the entrance, the secondary lock assembly including a lock, the tertiary lock including a detent, the method comprising:

pivoting the detent from a hold position to a release position and unlocking the lock by pivoting the lock out of the concavity, wherein when the detent is in the release position, the tertiary lock is unlocked wherein the tertiary lock includes:

a first shoulder disposed on a pivot axis P and adjacent to the lock of the secondary lock assembly;

a second shoulder disposed on the pivot axis P, the second shoulder spaced apart from the first shoulder;

a leg disposed between the first shoulder and the second shoulder;

a tab projecting outward from the leg;

a latch including a body and a catch, the body extending along the pivot axis P, the catch projecting outward from the body;

a bias member disposed on the pivot axis P and configured to exert a biasing force on the tertiary lock to urge the tertiary lock to the locked TL position; and a detent extending along a rocker axis R between a first end and a second end of the lock of the secondary lock assembly, the detent moveable between a hold position and a release position, wherein the detent is configured to exert, when in the hold position, a holding force against the latch that is greater than the biasing force exerted by the bias member, wherein when the detent is in the release position, the holding force applied by the detent against the latch is less than the biasing force applied by the bias member.

14. The method of claim 13, wherein the detent is a spring.

* * * * *